US009421451B2

(12) United States Patent
Laughlin

(10) Patent No.: US 9,421,451 B2
(45) Date of Patent: Aug. 23, 2016

(54) APPARATUS FOR DETECTING PLAYING CARD RANKS AND METHOD OF USE

(75) Inventor: Donald J. Laughlin, Laughlin, NV (US)

(73) Assignee: No Peek 21, Laughlin, NV (US)

( * ) Notice: Subject to any disclaimer, the term of this patent is extended or adjusted under 35 U.S.C. 154(b) by 434 days.

(21) Appl. No.: 12/973,136

(22) Filed: Dec. 20, 2010

(65) Prior Publication Data

US 2011/0148038 A1 Jun. 23, 2011

Related U.S. Application Data

(60) Provisional application No. 61/288,120, filed on Dec. 18, 2009.

(51) Int. Cl.

| | |
|---|---|
| ***A63F 9/24*** | (2006.01) |
| ***A63F 1/18*** | (2006.01) |
| *A63F 1/00* | (2006.01) |

(52) U.S. Cl.

CPC ..... *A63F 1/18* (2013.01); *A63F 2001/003* (2013.01); *A63F 2009/2419* (2013.01); *A63F 2009/2445* (2013.01)

(58) Field of Classification Search

CPC ..... A63F 2009/2419; A63F 2009/2445; A63F 1/18; A63F 2001/003

USPC ..... 463/12, 13, 29, 47; 235/462.01, 468; 273/148 A, 148 R, 150, 293, 296

See application file for complete search history.

(56) References Cited

U.S. PATENT DOCUMENTS

| | | | |
|---|---|---|---|
| 5,039,102 | A | 8/1991 | Miller |
| 5,110,134 | A | 5/1992 | Laughlin et al. |
| 5,219,172 | A | 6/1993 | Laughlin et al. |
| 5,224,712 | A | 7/1993 | Laughlin et al. |

(Continued)

FOREIGN PATENT DOCUMENTS

| | | | |
|---|---|---|---|
| JP | 2007-289784 | A | 11/2007 |
| WO | WO 2009-062513 | A1 | 5/2009 |

OTHER PUBLICATIONS

The physics Classroom, Light Absorbtion, Reflection, and Transmission, Light Waves and Color—Lesson 2, No Autor Listed, downloaded from (http://www.physicslassroom.com/class/light/u1212c.cfm) on Apr. 5, 2013. (4 Pages).*

(Continued)

*Primary Examiner* — David L Lewis
*Assistant Examiner* — Robert Mosser
(74) *Attorney, Agent, or Firm* — Greenberg Traurig, LLP

(57) ABSTRACT

A card reader apparatus including at least an ultraviolet emitter and ultraviolet detector for use with specialized playing cards marked at least partially with ultraviolet ink. In general, the ultraviolet detector is configured to determine an amount of light being reflected off of the specialized cards when subjected to ultraviolet light (or radiation) from the ultraviolet emitter. The corners of playing cards with ranks of 10 (i.e., tens and face cards) and aces are coated with an invisible ultraviolet ink such that the detector is able to distinguish playing cards with ranks between 2-9 from playing cards with ranks of 10 and ace. Responsive to the determination of the rank of the hole card, an indicator device illuminates to designate a blackjack or no blackjack. Alternatively, a pair of lights may be used to alert the dealer of the result.

11 Claims, 9 Drawing Sheets

(56) References Cited

U.S. PATENT DOCUMENTS

| | | | | |
|---|---|---|---|---|
| 5,259,907 | A * | 11/1993 | Soules et al. | 156/277 |
| 5,312,104 | A | 5/1994 | Miller | |
| 5,362,053 | A | 11/1994 | Miller | |
| 5,364,106 | A | 11/1994 | Laughlin et al. | |
| 5,681,039 | A | 10/1997 | Miller | |
| 6,652,379 | B2 | 11/2003 | Soltys et al. | |
| 7,510,194 | B2 | 3/2009 | Soltys et al. | |
| 7,573,209 | B2 * | 8/2009 | Ashdown et al. | 315/307 |
| 7,967,672 | B2 * | 6/2011 | Shigeta | 463/13 |
| 2002/0142820 | A1 | 10/2002 | Bartlett | |
| 2003/0107004 | A1 * | 6/2003 | Leach et al. | 250/372 |
| 2006/0001217 | A1 | 1/2006 | Soltys et al. | |
| 2006/0247036 | A1 | 11/2006 | Shigeta | |
| 2008/0224394 | A1 | 9/2008 | Shigeta | |

OTHER PUBLICATIONS

Science for Kids: Black Holes, No author Listed. Downloaded from (http://ducksters.com/science/black_hole.php) on Apr. 5, 2013. (2 Pages).*

* cited by examiner

280

No Peek 21 UV

Bill of Materials

| PART TYPE | MANUFACTURER PART | QTY / ASM | | VENDOR | VENDOR P/N |
|---|---|---|---|---|---|
| VOLTAGE REGULATOR -5V | MICROCHIP MCP1802T-5002I/OT | 2 | | DIGI-KEY | MCP1802T-50021/OTCT-ND |
| RELAY | PANASONIC AGQ2004H | 2 | | DIGI-KEY | 255-1357-5-ND |
| PHOTO INTERRUPTER | SHARP GP1S094HCZOF | 2 | | DIGI-KEY | 425-1964-5-ND |
| UV PHOTO REFLECTOR | SHINKOH KR1570 | 2 | | MEDLAND | KR1570 |
| TRANSISTOR | NTE NTE85 | 7 | | KIESUB | NTE85 |
| TRANSISTOR | NTE NTE123AP | 2 | | KIESUB | NTE123AP |
| TRANSISTOR | NTE NTE290A | 4 | | KIESUB | NTE290A |
| I.C. | NTE 74HC00 | 2 | | KIESUB | NTE74HC00 |
| I.C. | 74LS00D | 2 | | MOUSER | 595-SN74LS00D |
| I.C. | 74LS123D | 2 | | DIGI-KEY | 296-1635-5-ND |
| I.C. | LM555CM/NOPB | 2 | | DIGI-KEY | LM555CM-ND |
| DIODE | NTE519 | 3 | | KIESUB | NTE519 |
| RESISTOR 47 OHM 1/6 W | YAEGO CFR-12JB-47R | 2 | | DIGI-KEY | 47EBK-ND |
| RESISTOR 100 OHM 1/6 W | YAEGO CFR-12JB-100R | 4 | | DIGI-KEY | 100EBK-ND |
| RESISTOR 150 OHM 1/6 W | YAEGO CFR-12JB-150R | 2 | | DIGI-KEY | 150EBK-ND |
| RESISTOR 300 OHM 1/6 W | YAEGO CFR-12JB-300R | 2 | | DIGI-KEY | 300EBK-ND |
| RESISTOR 390 OHM 1/6 W | YAEGO CFR-12JB-390R | 2 | | DIGI-KEY | 390EBK-ND |
| RESISTOR 2.7K OHM 1/6 W | YAEGO CFR-12JB-2K7R | 2 | | DIGI-KEY | 2.7KEBK-ND |
| RESISTOR 4.7K OHM 1/6 W | YAEGO CFR-12JB-4K7R | 10 | | DIGI-KEY | 4.7KEBK-ND |
| RESISTOR 6.8K OHM 1/6 W | YAEGO CFR-12JB-6K8R | 2 | | DIGI-KEY | 6.8KEBK-ND |
| RESISTOR 10K OHM 1/6 W | YAEGO CFR-12JB-10KR | 5 | | DIGI-KEY | 10KEBK-ND |
| RESISTOR 20K OHM 1/6 W | YAEGO CFR-12JB-20KR | 2 | | DIGI-KEY | 20KEBK-ND |
| RESISTOR 56K OHM 1/6 W | YAEGO CFR-12JB-56KR | 2 | | DIGI-KEY | 56KEBK-ND |
| RESISTOR 680K OHM 1/6 W | YAEGO CFR-12JB-680KR | 2 | | DIGI-KEY | 680KEBK-ND |

FIG. 8

| | | | | | |
|---|---|---|---|---|---|
| CAPACITOR 100uF 6.3V | KEMET T350H107K006AT | 4 | | DIGI-KEY | 399-3583-ND |
| CAPACITOR 10uF 6.3V | KEMET T350B106K006AT | 4 | | DIGI-KEY | 399-3548-ND |
| CAPACITOR 4.7uF 6.3V | KEMET T350A475K006AT | 2 | | DIGI-KEY | 399-3543-ND |
| CAPACITOR 1uF 25V | KEMET T350A105K025AT | 2 | | DIGI-KEY | 399-3528-ND |
| CAPACITOR 0.1uF 50V | MURATA RPER71H104K2P1A03B | 2 | | DIGI-KEY | 490-3810-ND |
| CAPACITOR 0.01uF 50V | MURATA RPER71H104K2P1A03B | 2 | | DIGI-KEY | 490-3812-ND |
| LED - DUAL RED/GREEN | | 1 | | KIESUB | L519SRSGC-CA |
| POWER PACK 6VDC>=500 ma. | | 1 | | KIESUB | LR10-060 |
| POWER RECEPTACLE | | 1 | | KIESUB | 48-1021 |
| printed circuit board | 21-17-uva | 1 | | KIESUB | |
| printed circuit board | 21-17-uvb | 1 | | KIESUB | |
| plastic housing | 21-20-uv | 1 | | KIESUB | |

FIG. 8
CONTINUED

APPARATUS FOR DETECTING PLAYING CARD RANKS AND METHOD OF USE

CROSS-REFERENCE TO RELATED APPLICATIONS

This application claims the benefit of U.S. Provisional Patent Application No. 61/288,120 filed on Dec. 18, 2009.

FIELD OF THE INVENTION

The embodiments of the present invention relate to a device for detecting the rank of certain playing cards being used in a live game of chance (e.g., blackjack).

BACKGROUND

The game of Blackjack is commonly played in casinos worldwide. In a casino, the game of Blackjack involves a dealer and one or more players who play against cards dealt by the dealer. Another rule, basic to the game, is that each player attempts to draw cards until the sum of the cards are as close to twenty-one as possible, without exceeding twenty-one. Whenever the sum of the cards in a single hand exceeds twenty-one, the player or dealer, holding the cards loses.

Cards are dealt to each player, including the dealer, with at least one card (the "hole" card) face down. To speed play, when the dealer shows a card which is a member of a blackjack pair of cards, the hole card is commonly privately perused by the dealer to see if the hole card is the other member of the blackjack pair. If the hole card is the other member of the blackjack pair, play stops and the dealer wins.

Those skilled in the art of Blackjack understand that statistics play a very important part in winning or losing. Card counting methods have been conceived and developed through the years for integrating knowledge of cards played into a scheme which determines the magnitude of a bet, or whether another card should be taken. Equally as important, when a player is making a decision about whether or not to ask for another card, is a knowledge of the value of the dealers hole card, especially when the showing card is a face card.

For an unscrupulous dealer, who has a player as an accomplice, a look at the hole card, to determine whether or not the dealer's cards comprise a blackjack, provides an opportunity to determine the value of the dealer's hand. With knowledge of the value of the hole card, the unethical dealer is able to signal the player accomplice the relative value of the card in a manner which is subtle and generally undetectable by casino management. With such knowledge, the accomplice makes a more knowledgeable decision concerning requesting or declining being hit with another card and thereby significantly tilts the odds of winning away from the casino. Even without dealer involvement a player may use an accomplice behind the dealer at another table to catch the value of the dealer's hole card when the dealer checks the hole card and then transmit the value to the player.

Therefore, there is a need for an apparatus which enables dealer's to identify the hole card without exposing the hole card.

SUMMARY

Accordingly, a first embodiment of the present invention comprises a card reader apparatus including at least an ultraviolet emitter and ultraviolet detector for use with specialized playing cards marked at least partially with ultraviolet ink. In general, the ultraviolet detector is configured to determine an amount of light being reflected off of the specialized cards when subjected to ultraviolet light (or radiation) from the ultraviolet emitter. In one embodiment, the corners of playing cards with ranks of 10 (i.e., tens and face cards) and aces are coated with an invisible ultraviolet ink such that the detector is able to distinguish playing cards with ranks between 2-9 from playing cards with ranks of 10 and ace. Responsive to the determination of the rank of the hole card, an indicator device illuminates to designate a blackjack or no blackjack. Alternatively, a pair of lights may be used to alert the dealer of the result.

Such an apparatus and specialized playing cards allow a dealer to determine whether his hand comprises a blackjack or no blackjack without exposing his or her hole card. More specifically, when the dealer's face-up card is a ten, face card or an ace, the dealer slides the pair of cards (one face up and one face down) into an apparatus housing such that the face-down card is exposed to ultraviolet light wherein reflected light is read by the ultraviolet detector.

Other variations, embodiments and features of the present invention will become evident from the following detailed description, drawings and claims.

BRIEF DESCRIPTION OF THE DRAWINGS

FIG. 8 illustrates a bill of materials for the layouts shown in FIGS. 6 and 7.

DETAILED DESCRIPTION

Figure 1:
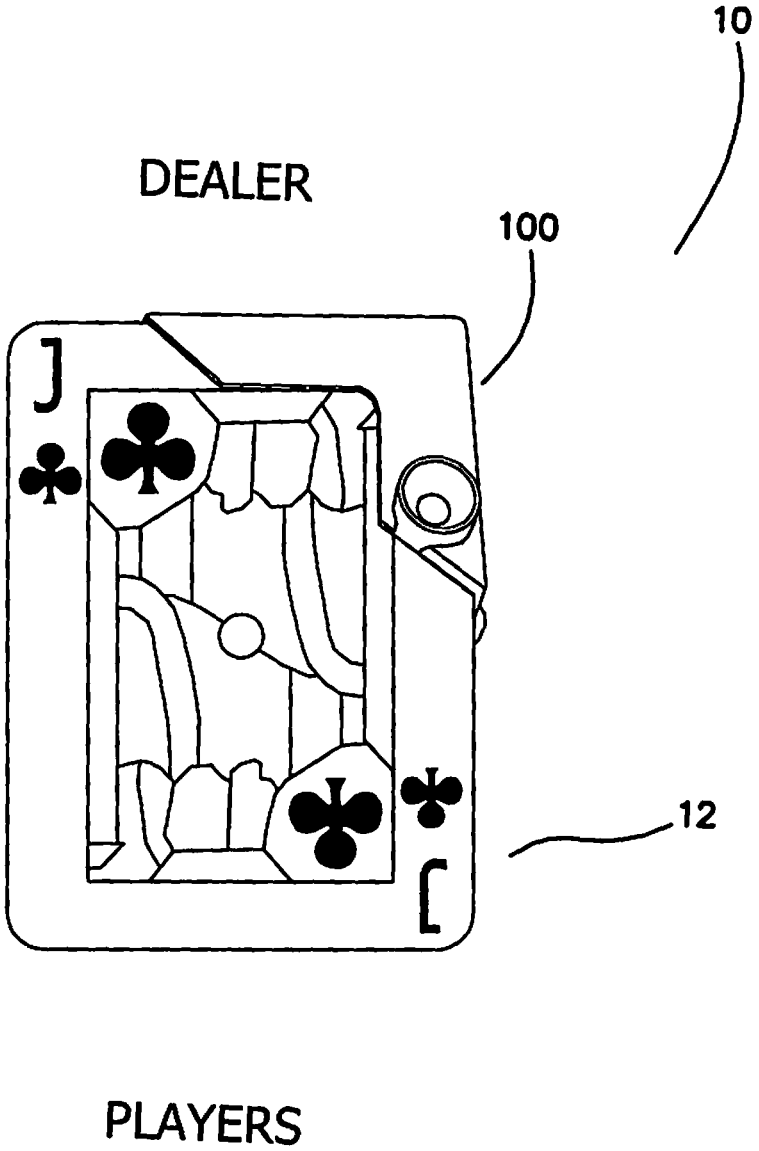
FIG. 1 illustrates a blackjack gaming table having a card detection apparatus according to the embodiments of the present invention installed thereon.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention relate to an apparatus for detecting playing card ranks. While the embodiments may be used to facilitate and improve any card game, the disclosure below focuses on the game of blackjack which is the game which at this time benefits most from the apparatus. Applicant incorporates herein for all purposes U.S. Pat. Nos. 5,110,134, 5,219,172, 5,224,712 and 5,364,106.

FIG. 1 shows a blackjack gaming table 10 with a card detection apparatus 100 installed thereon. The playing surface 12 of the table 10 is covered with a felt or other material well known and commonly used in the game of blackjack and whereupon cards are dealt to a dealer and players. The apparatus 100 is installed proximate the dealer since it is the dealer that utilizes the apparatus 100 when needed.

Figure 2:
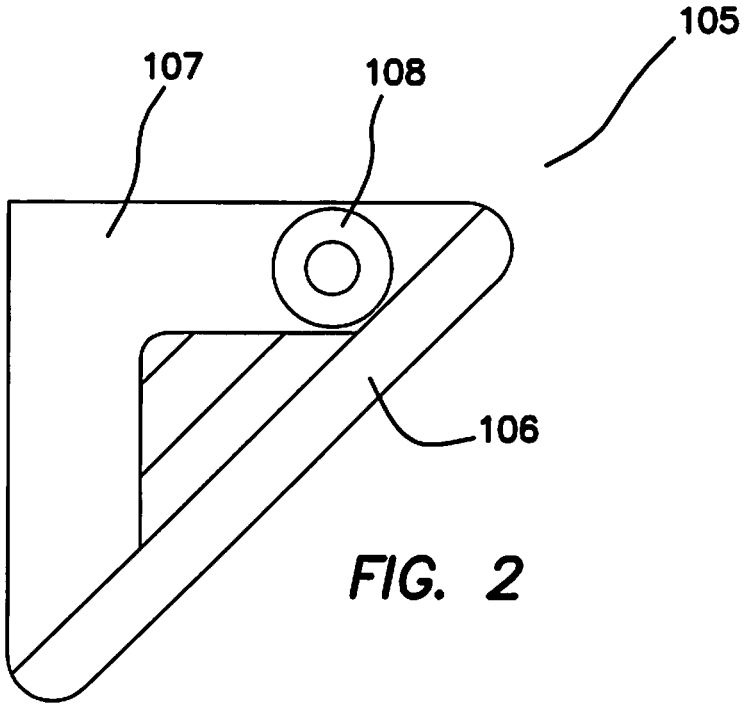
FIG. 2 illustrates an exemplary housing for a card detection apparatus according to the embodiments of the present invention.

A housing 105 of the apparatus 100 is shown in FIG. 2. As shown, the housing 105 is triangular in shape to facilitate receipt of the corner of playing cards. A lower surface 106 of the housing is installed substantially flush with the playing surface 12 of the gaming table 10 to allow playing cards to be slid or inserted into the apparatus 100 without having to lift a face-down card thereby preventing exposure of the face-down card. A top surface 107 of the housing 105 conceals the cards within the apparatus and limits external light interfering with the operation of the apparatus 100. A light emitting diode 108 indicates whether the two dealer's cards form a blackjack.

Figure 4A:
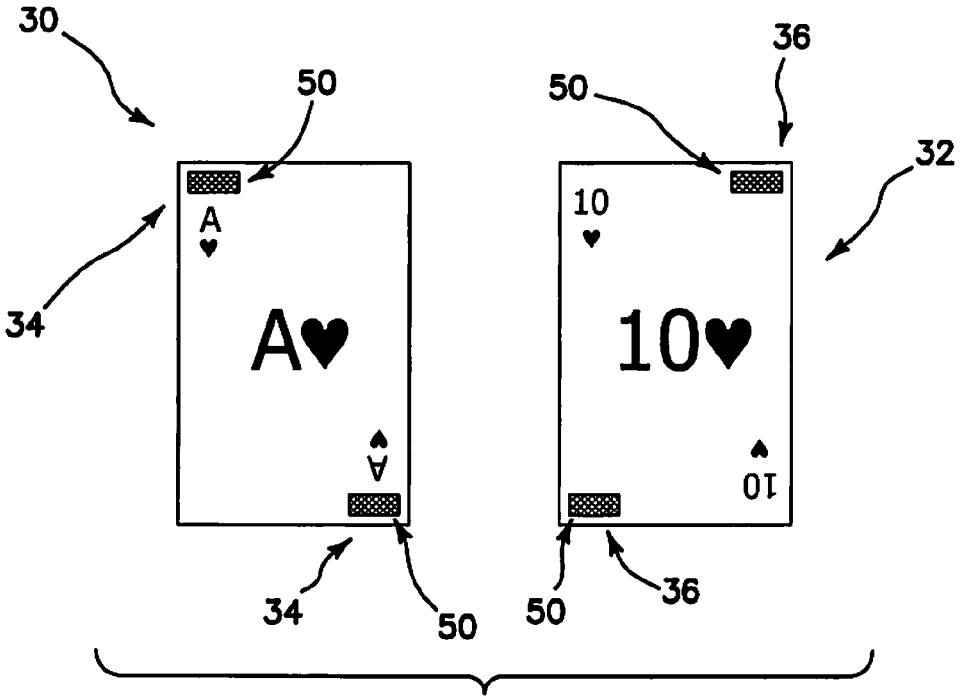
FIG. 4*a* illustrates exemplary playing cards for use with the card detection apparatus according to the embodiments of the present invention.

FIG. 4*a* shows a playing card 30 having a rank of ace and a second playing card 32 having a rank of King. In this blackjack embodiment, only face cards, tens and aces include an invisible rank designation mark 50. In this instance, the invisible rank designation mark 50 is in the form of ultraviolet ink (shown as a rectangle with a black background and white dots for purposes of reference). It should be understood that in practice the ultraviolet ink is not visible to players under normal conditions.

Figure 3A:
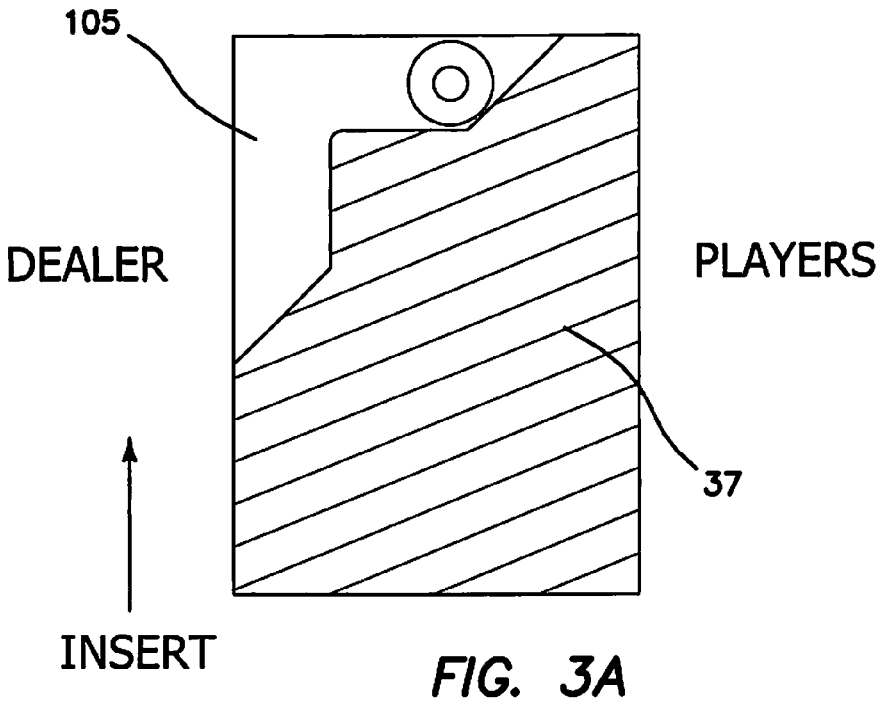
FIGS. 3*a* and 3*b* illustrates a pair of dealer's cards inserted into the card detection apparatus according to the embodiments of the present invention.
Figure 3B:
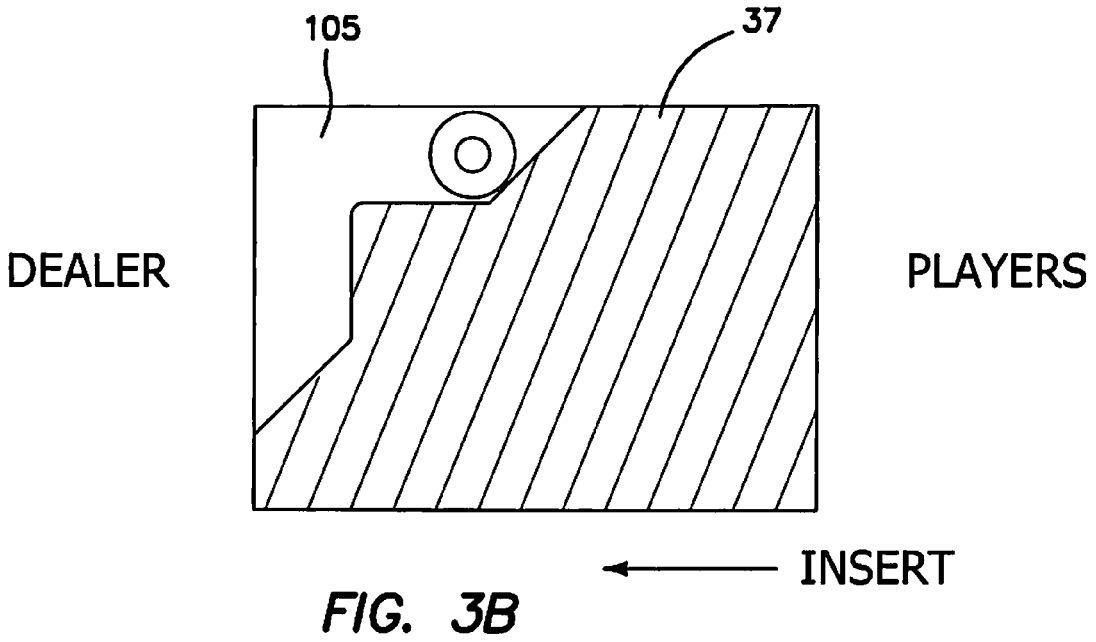

Each card 30, 32 comprises a set of opposing corners 34 or 36. An ultraviolet ink mark 50 is placed in each corner 34 not containing identifying indicia 38 for each ace in a deck of playing cards. For the group of cards comprising tens and face cards an ultraviolet ink mark 50 is placed in each corner 36 disposed such that identifying indicia remain readable. Those skilled in art will recognize that the ultraviolet ink mark 50 may be placed elsewhere on the cards. FIGS. 3*a* and 3*b* show the orientation of face-down dealer cards being inserted into the housing 105. In FIG. 3*a* the face-up card would be an Ace and in FIG. 3*b* the face-up card would be a ten. With the orientations shown, the ultraviolet ink marks 50, if any, on the face-down cards 37 are ensured of being in the apparatus 100.

Figure 4B:
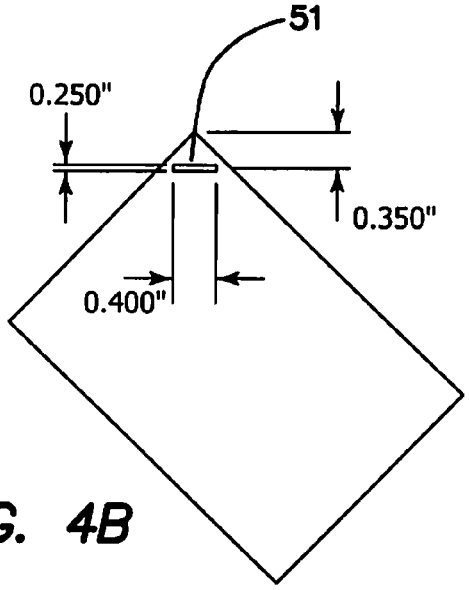
FIG. 4*b* illustrates another exemplary playing card for use with the card detection apparatus according to the embodiments of the present invention.

FIG. 4*b* shows another exemplary card with the ultraviolet ink mark 51 angled relative to the card edges. Specifically, the ultraviolet ink mark 51 is 0.35" inches from the corner of the card. As shown, the ultraviolet ink mark is 0.40" in length and 0.25" wide. In practice the mark 51 would be in the opposite corner as well. The size and location of the ultraviolet ink mark 51 is not limited to FIG. 4*b* and may be placed elsewhere and dimensioned differently.

As is well known a blackjack comprises a two-card total of 21 such that a blackjack comprises one card from each of two groups of cards discussed above. As set forth above, each ace comprises mark 50 in each corner 34 and each ten and face card comprises mark 50 in each corner 36 as seen in FIGS. 4*a* and 4*b*. In this manner, the cards may be differentiated by which corner is inserted into apparatus 100.

If the face-up card is a face card or a ten, play is legitimately speeded by a test to see if the hole card is an ace and dealer therefore, has a blackjack. Similarly, if the face-up card is an ace, play is speeded by a test to see if hole card is a face card or ten.

Figure 5:
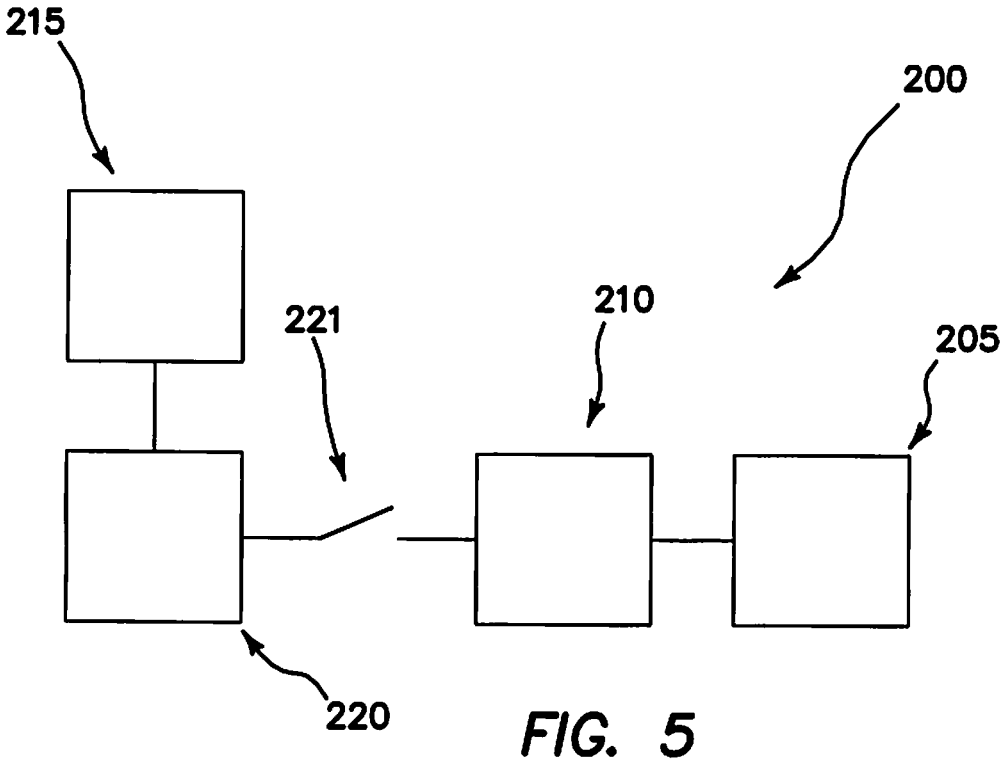
FIG. 5 illustrates a block diagram of the card detection apparatus according to the embodiments of the present invention.

Now referring to FIG. 5, a block diagram 200 shows a system facilitating operation of the apparatus 100. The apparatus 100 includes an ultraviolet emitter 205, ultraviolet detector 210, power source 215, a photo interrupter 220, switch 221 and indicator device 225. In practice, once a card is inserted into the housing 105 the photo interrupter 220 senses the card and closes switch 221 thereby connecting the power source 215 to the system to draw power from the power source 215 to the system. The photo interrupter 220 may be replaced with a switch lever and switch activator. The power source may be a battery or AC power means. Once power is applied to the system, in one embodiment, the ultraviolet emitter 205 emits pulsed width modulation ultraviolet light (radiation) onto the corner of the face-down card inserted into the housing 105. The ultraviolet detector 210 then measures or senses an amount of light reflected off of the exposed card corner. If the measurement or sensed level of light is above a threshold amount, the indicator device 225 is illuminated in red to signify a game stoppage as the dealer has blackjack. If the measurement or sensed level of reflected light is below a threshold amount, the indicator device 225 is illuminated in green to signify a game continuance as the dealer does not have blackjack. In one embodiment, the received, reflected light pulses are amplified by transistors to assist with the determination.

Figure 6:
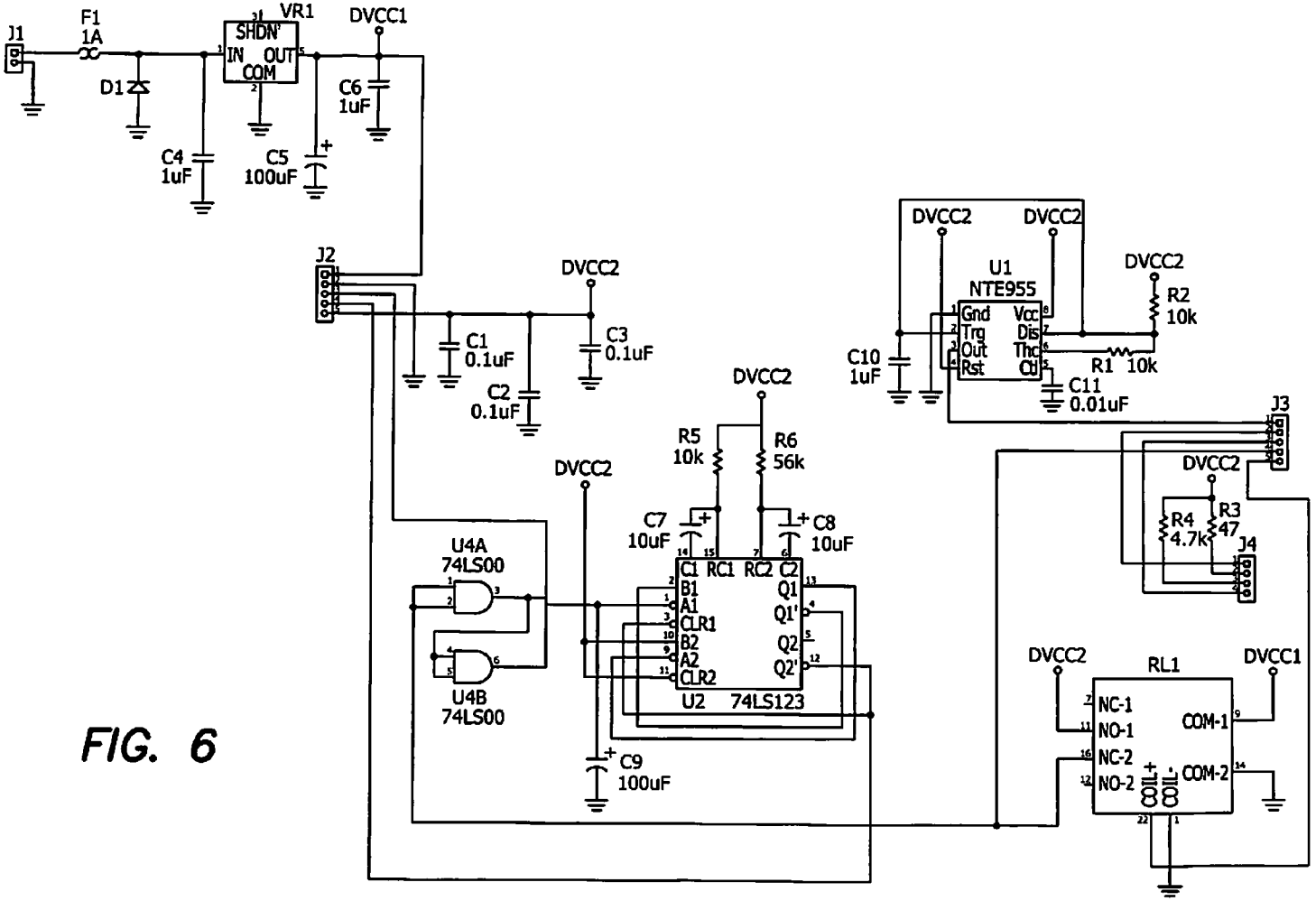
FIG. 6 illustrates an exemplary integrated circuit layout according to the embodiments of the present invention.
Figure 7:
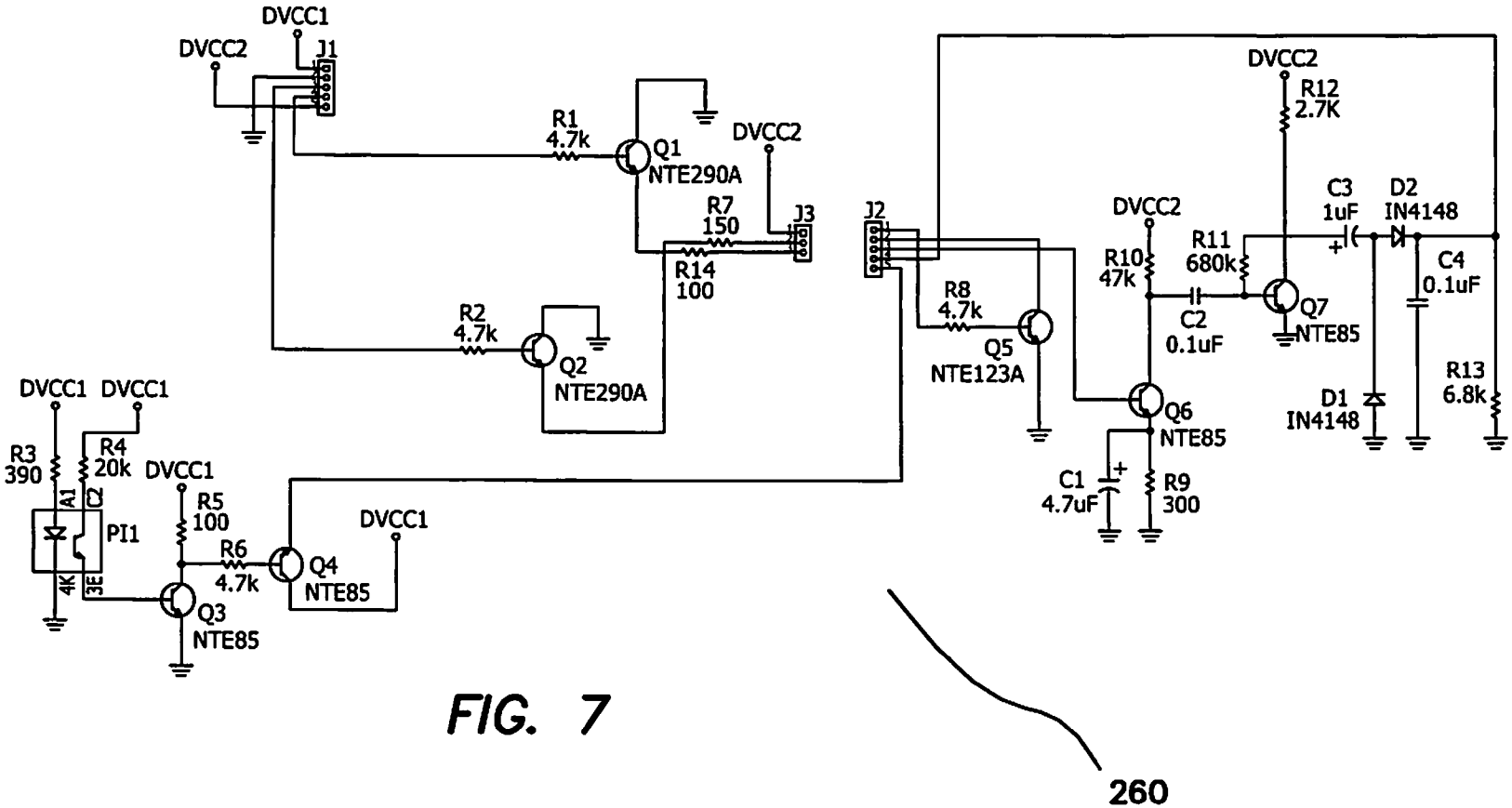
FIG. 7 illustrates an exemplary transistor circuit layout according to the embodiments of the present invention.

In one embodiment, some or all of the components shown in block diagram 200 are positioned on, or in communication with, a printed circuit board. FIGS. 6 and 7 show an exemplary integrated circuit layout 250 and transistor circuit layout 260, respectively, and FIG. 8 shows an exemplary bill of materials 280 associated with the layouts 250, 260. The majority of the hardware components are positioned below the playing surface of the playing table 10. In one example, the components (e.g., battery, printed circuit board, etc.) are contained within a housing secured to an underside of the table 10.

As shown in FIG. 3*b*, hole card 19 is maintained in a face down position and detectable corner is moved proximally to housing 105 when the face-up card 18 is a face card or ten. Once hole card 19 is disposed, as shown in FIG. 3*b*, the ultraviolet emitter 205 emits ultraviolet light which causes the mark 50, if present, to reflect light. The ultraviolet detector 210 measures an amount of reflected light to determine whether the mark 50 is present. If the measured amount of light is below a threshold amount, the indicator device 225 in the form of a light emitting diode illuminates in green signaling that the face-down or hole card 19 is not an Ace such that the game should continue. If the measured amount of light is above a threshold amount, the indicator device 225 illuminates in red signaling that the face-down card 19 is an ace and that the game should be stopped. That is, if ultraviolet ink mark 50 is on the corner of a card, light will be generated as a result of application of ultraviolet light transmitted by the ultraviolet emitter 205 allowing the ultraviolet detector 210 to determine whether the face-down card has the ultraviolet mark 50 or not. That is, the application of ultraviolet light to an ultraviolet ink mark turns the mark from invisible to visible such that an amount of reflected light may be measured.

If the face-up card 20 is an ace, hole card 21 is maintained in a face down position, but rotated 90 degrees to be disposed at housing 105 as shown in FIG. 3*a*. Thus oriented, a corner of the hole card 21 is subjected to ultraviolet light emitted by ultraviolet emitter 205. The ultraviolet detector 210 measures an amount of reflected light to determine whether the mark 50 is present. If the measured amount of light is below a threshold amount, the indicator device 225 illuminates in green signaling that the face-down or hole card 21 is not a ten or face card such that the game should continue. If the measured amount of light is above a threshold amount, the indicator device 225 illuminates in red signaling that the face-down card 21 is a ten or face card and that the game should be stopped.

In one embodiment, to facilitate the detection of the reflected light, the card faces are printed, stamped or otherwise applied to non-reflective card stock. In this manner, the card stock does not reflect any of the ultraviolet light emitted by the ultraviolet emitter 205 thereby avoiding inaccurate readings which could impact the integrity of the game being played.

Figure 9:
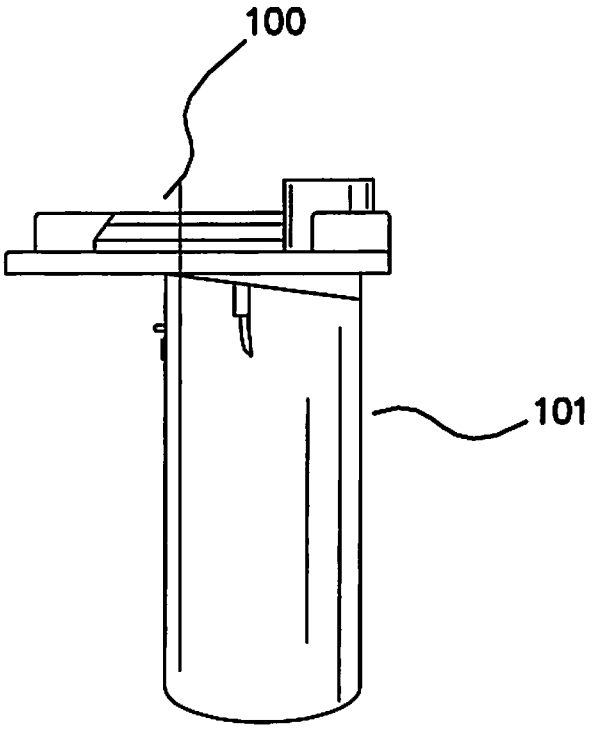
FIG. 9 illustrates an exemplary housing configured to contain the electronics associated with the card detection apparatus according to the embodiments of the present invention.

FIG. 9 shows a card detection apparatus 100 with an electronics housing 101 connected thereto. The tubular housing 101 is configured to contain the electronics associated with operating the card detection apparatus 100 as described above. In this manner, after installation, the tubular housing 101 sits below the card table while the card detection apparatus 100 is at table top level. Those skilled in the art will understand that the housing 101 may take on other shapes and dimensions.

Accordingly, one group of cards each comprising an ace is detected independently from the other group comprising a face card or ten. Importantly, the dealer knows proper orientation of the face-down card to be read by the value of the face-up card.

The embodiments of the present invention may be embodied in other specific forms without departing from the spirit or essential characteristics thereof. The present embodiments are therefore to be considered in all respects as illustrative and not restrictive.

I claim:

1. A card detection apparatus comprising:

a housing configured to receive at least one playing card wherein a playing card is selected from a group of playing cards having tens, aces and face cards marked with ultraviolet ink surface of said playing cards;

an ultraviolet emitter configured to emit pulsed width ultraviolet light responsive to a playing card being inserted into said housing;

an ultraviolet detector configured to measure an amount of light reflected off of a playing card; and an indicator device configured to illuminate based on an amount of measured light detected by said ultraviolet detector such that said indicator device illuminates in manner consistent with: 1) continued game play if said amount of measured light detected by said ultraviolet detector is below a threshold amount; and 2) game stoppage if said amount of measured light detected by said ultraviolet detector is above said threshold amount.

2. The card detection apparatus of claim 1 wherein the housing is configured to receive corners of the playing cards.

3. The card detection apparatus of claim 1 wherein said indicator device comprises a pair of illumination devices with a first one used to notify a dealer to continue game play and a second one used to notify a dealer to stop game play.

4. A card detection method comprising:

configuring a housing to receive at least one playing card wherein a playing card is selected from a group of playing cards having tens, aces and face cards marked with ultraviolet ink on surface of said playing cards;

emitting pulsed width ultraviolet light on a face of a playing card responsive to a playing card being inserted into a housing;

measuring an amount of light reflected off of said face of a playing card; and configuring an indicator device to illuminate based on an amount of measured light detected by said ultraviolet detector such that said indicator device illuminates in manner consistent with: 1) continued game play if said amount of measured light detected by said ultraviolet detector is below a threshold amount: and 2) game stoppage if said amount of measured light detected by said ultraviolet detector is above said threshold amount.

5. The card detection method of claim 4 further comprising configuring the housing to receive corners of the playing cards.

6. The card detection method of claim 4 further comprising configuring said indicator device as a pair of illumination devices such that a first one notifies a dealer to continue game play and a second one notifies a dealer to stop game play.

7. The card detection method of claim 4 further comprising amplifying reflected light off of a playing card.

8. A card detection apparatus comprising:

a housing configured to receive at least one playing card wherein a playing card is selected from a group of playing cards having tens, aces and face cards marked with ultraviolet ink on a surface of said playing cards;

an ultraviolet emitter configured to emit pulsed width ultraviolet light responsive to a playing card being inserted into said housing;

means for amplifying light reflected off of a playing card inserted into said housing;

an ultraviolet detector configured to measure an amount of light reflected off of a playing card inserted into said housing; and an indicator device configured to illuminate based on an amount of measured light detected by said ultraviolet detector such that said indicator device illuminates in manner consistent with: 1) continued game play if said amount of measured light detected by said ultraviolet detector is below a threshold amount; and 2) game stoppage if said amount of measured light detected by said ultraviolet detector is above said threshold amount.

9. The card detection apparatus of claim 8 wherein the housing is configured to receive corners of the playing cards.

10. The card detection apparatus of claim 8 wherein said indicator device comprises a pair of illumination devices with a first one used to notify a dealer to continue game play and a second one used to notify a dealer to stop game play.

11. The card detection apparatus of claim 8 wherein said means for amplifying light reflected off of a playing card inserted into said housing comprises one or more transistors.

* * * * *